United States Patent [19]
Takesako et al.
[11] 4,417,184
[45] Nov. 22, 1983

[54] PICTURE IMAGE DISPLAY APPARATUS

[75] Inventors: Yoshinobu Takesako, Neyagawa; Masanori Watanabe, Katano; Kinzo Nonomura, Hirakata, all of Japan

[73] Assignee: Matsushita Electric Industrial Co., Ltd., Kadoma, Japan

[21] Appl. No.: 250,714

[22] Filed: Apr. 3, 1981

[30] Foreign Application Priority Data

Aug. 4, 1980 [JP] Japan ..... 55-110896[U]

[51] Int. Cl.[3] ..... H01J 29/70; H01J 29/72
[52] U.S. Cl. ..... 315/366; 313/422
[58] Field of Search ..... 315/366; 313/422

[56] References Cited

U.S. PATENT DOCUMENTS 3,935,500 1/1976 Oess .
4,227,117 10/1980 Masanori et al. .

FOREIGN PATENT DOCUMENTS 55-33734 3/1980 Japan .

OTHER PUBLICATIONS

"The Physical Mechanisms of Feedback Multiplier Electron Sources", Carmen A. Catanese & John G. Endriz, *SID Digest*, 1978, pp. 122–127.

*Primary Examiner*—Theodore M. Blum
*Attorney, Agent, or Firm*—Cushman, Darby & Cushman

[57] ABSTRACT

The picture image display apparatus in accordance with the present invention comprises:

a flat type vacuum enclosure having a transparent face panel, a row of parallelly disposed linear thermionic cathodes, electron beam forming electrode which produces a predetermined number of two dimensionally disposed electron beams out of the electron emission from said linear thermionic cathodes, a row of control electrodes disposed parallelly in a direction perpendicular to those of said linear thermionic cathodes, a row of deflection electrodes, a phosphor screen formed on the inner face of said face panel, and an anode of thin metal film formed on said surface of said phosphor screen, wherein the improvement is that a row of deflection-aiding electrodes is disposed between said row of deflection electrode and said anode, said post deflection electrodes being impressed with substantially constant positive potential with respect to said linear thermionic cathodes.

6 Claims 14 Drawing Figures

FIG.1 (a) (PRIOR ART)
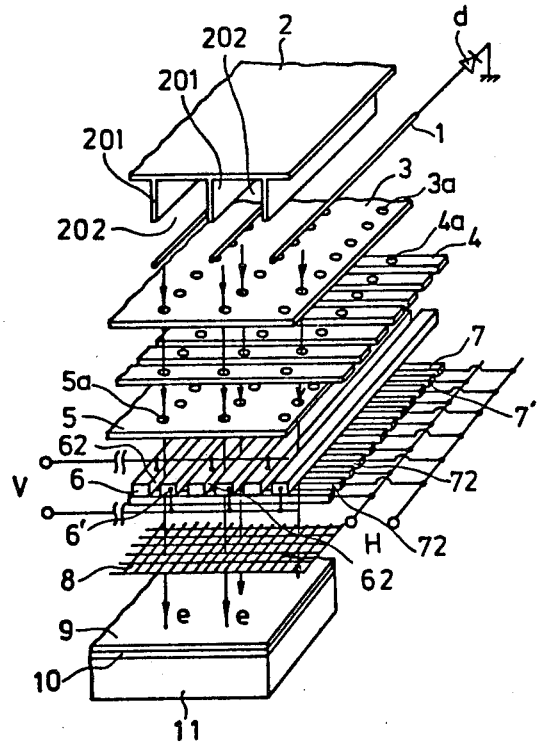
FIG.1 (b) (PRIOR ART)
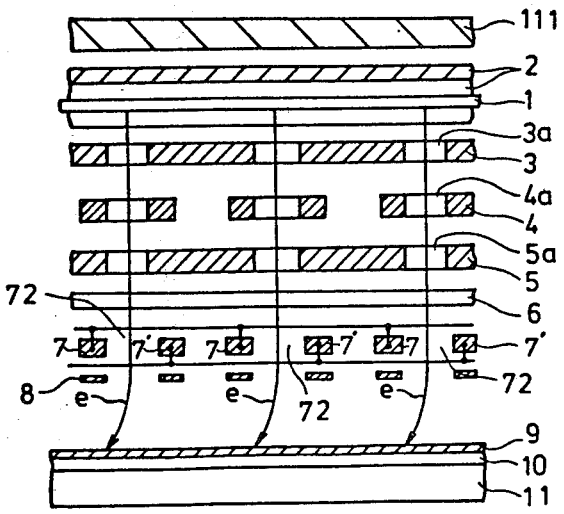

FIG. 1 (c) (PRIOR ART)
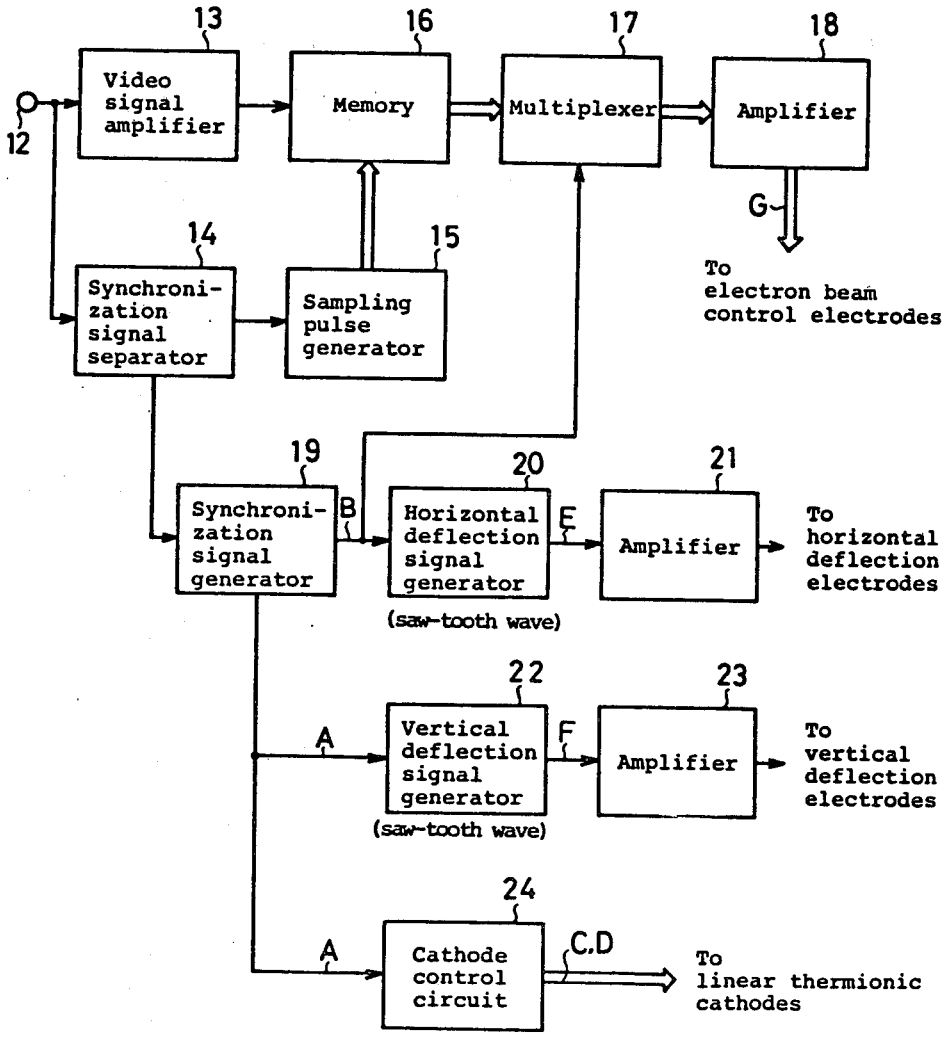

FIG. 1 (d) (PRIOR ART)
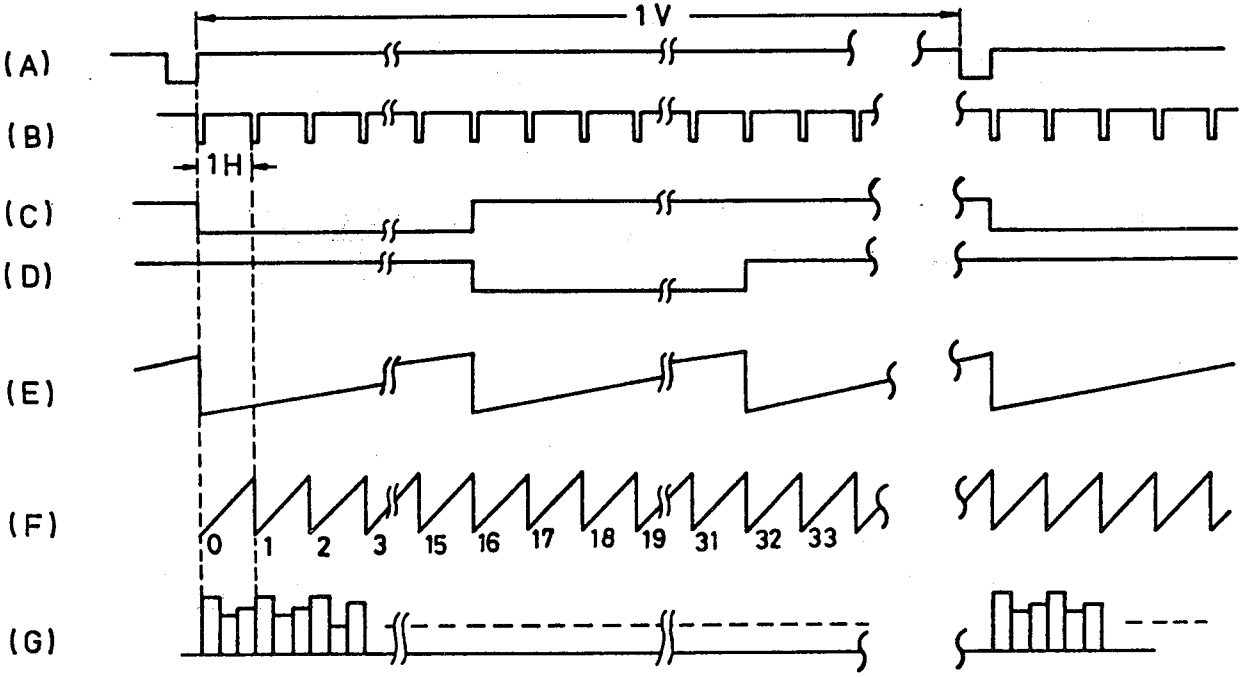

FIG. 1 (e) (PRIOR ART)
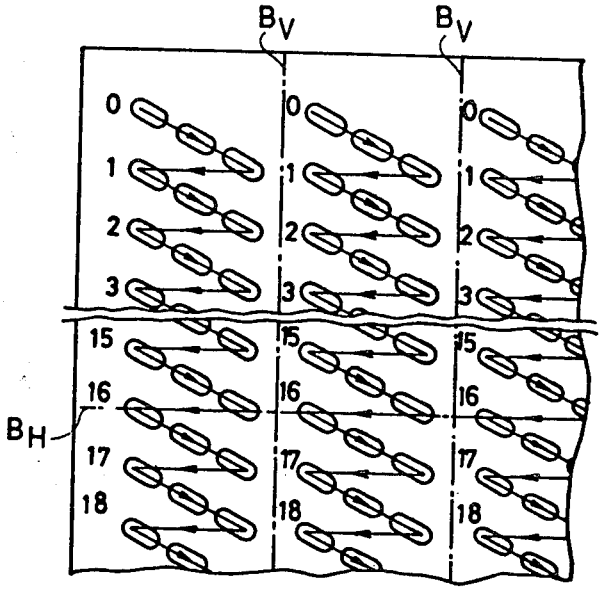

PICTURE IMAGE DISPLAY APPARATUS

BACKGROUND OF THE INVENTION

1. Field of the Invention

The present invention relates to an improvement of a multiple electron beam type flat picture image display apparatus and especially concerns the picture image display apparatus having a novel structure capable of reducing deflection voltage and obtaining high quality picture display.

2. Description of the Prior Art

Several proposals have been made on multiple electron beam type flat shaped picture display device, for example in the U.S. Pat. No. 3,935,500 (to Oess et al.) and SID 78 Digest pp. 122 to 127. Furthermore, and this is not truly prior art since it is one, the same three inventors of the present invention who have invented and proposed a multiple electron beam type picture display apparatus described in the specification of the Japanese Patent Application No. Sho 53-106788 filed on Aug. 30, 1978 (laid open as unexamined patent gazette No. Sho 55-33734 on Mar. 10, 1980) and also described in the specification of the U.S. Pat. No. 4,227,117 (to Watanabe et al.) patented on Oct. 7, 1980.

The structure of picture image display apparatus of the abovementioned described invention is shown in FIG. 1(*a*) which is an exploded view of the principal part of the apparatus. The apparatus comprises, as shown from the upper part to the lower part in FIG. 1(*a*), and FIG. 1(*b*), an isolation electrode 2 having a plural number of isolation walls 201 to define oblong isolated spaces 202, a row of predetermined number M (e.g. M=15) of linear thermionic cathodes 1 disposed in parallel (i.e., line cathodes, each of which comprises a linear filament line to be heated by a low voltage, e.g., D.C. 10 V and electron emissive oxide coating thereon, and hereinafter is referred to as linear thermionic cathode) each being disposed in the isolated spaces 202, an extractor electrode 3 having a predetermined number N (e.g. N=107) of electron beam passing apertures 3*a* disposed in rows below the linear thermionic cathodes 1, a row of control electrodes 4 for controlling beam intensity disposed parallelly in a direction perpendicular to those of said linear thermionic cathodes 1 each having electron beam passing openings 4*a* below the apertures 3*a*, an electron beam forming electrode 5 having electron beam passing openings 5*a* below the openings 4*a*, a row of vertical deflection electrodes comprising pairs of common-connected first electrodes 6 and common-connected second electrodes 6', a row of horizontal deflection electrodes comprising pairs of common-connected first electrodes 7 and common-connected second electrodes 7', and electric field shielding electrode 8, and anode 9 of vapor-deposited thin aluminum film, and a phosphor screen 10 formed on a face panel 11 of a vacuum enclosure and under said anode 9. Every electron beam e, e . . . passes through deflection spaces 62, 62 . . . and 72, 72 . . . defined by the deflection electrodes pairs 6, 6' . . . and 7, 7' . . . disposed regularly in the same order with respect to every electron beam as shown in FIG. 1(*a*) and FIG. 1(*b*).

In the operation of such multiple electron beam type display apparatus described in the abovementioned specifications, scannings of beam spots on the phosphor screen are made in the known line-at-a-time type scanning, wherein ordinary time-sequential image signal is converted into a plural number of parallel signals. For example, by taking a case to display an image field raster having numbers of picture elements of 240 (in vertical direction) times 321 (in horizontal direction), with regard to the horizontal scanning of the beam spots the raster is divided into a plural number N of vertically oblong sections, wherein the horizontal scannings are carried out simultaneously in all of N sections. Then, each section has picture elements of n=(321/N) in the horizontal direction. For example, when the number N of the vertical sections is 107, the number n of picture elements in each section is 3. For such example, 107 beam spots are produced from each linear thermionic cathode and 107 control electrodes are provided in order to control the 107 electron beam intensities. In the apparatus, the horizontal scanning is made by using sawtooth wave having a horizontal scanning period H applied to the horizontal deflection electrode and in a manner that all the N beam spots are deflected simultaneously to scan in the same direction taking one horizontal scanning period H. The horizontal scanning period H is equal to the horizontal scanning period of the ordinary time sequential television signal. In order for attaining such line-at-a-time-scanning, the ordinary time sequential image signal is preliminarily converted into the N parallel signals of the line-at-a-time type.

The vertical scanning of the described apparatus is made by dividing the raster into a plural number M of horizontally oblong sections, and at first in the first section, for example in the uppermost section, the plural number of beam spots, which simultaneously scan, also scan vertically (downwards). When the vertical scanning in the first section is over and all the beam spots reach the bottoms of the first horizontally oblong sections, then the forming of electron beams from the electron from the first linear thermionic cathode ends and the forming of electron beams from the electrons from the second linear thermionic cathode starts, and the vertical scannings of the beam spots start in the second horizontally oblong section and scan downwards in the same way as in the first section. The vertical scanning is made thus downwards to the bottom or M-th section by applying a saw-tooth wave having a period V/M, where V is the vertical scanning period of the ordinary television signal. For the abovementioned example of the raster having the number of vertical picture element of 240, when the number M of the horizontally oblong sections is 15, each of the section has the horizontal scanning lines of a number of m=(240/15)=16. That is to say, the example apparatus uses 15 linear thermionic cathodes, and each cathode vertically scans to produce 16 horizontal scanning lines.

FIG. 1(*c*) shows a block diagram of an example of the circuit for driving the abovementioned apparatus described in the abovementioned specifications. The circuit of FIG. 1(*c*) is constituted as follows. A video signal from the input terminal 12 is led to a video signal amplifier 13 and a synchronization signal separator 14, output of which is given to a sampling pulse generator 15 and a synchronization signal generator 19. A memory circuit 16 receives time sequential signal from the video amplifier 13 and sample-hold it in order for conversion it to the parallel type video signal by a multiplexer 17. That is, the multiplexer 17 takes out memorized video signal from the memory 16 and rearranges it into the N (=107) parallel signals, in each of which n (=3) data in the memory 16 are rearranged into time sequential signal to take the time period of H. The parallel outputs of the multiplexer 17 are given through an amplifier 18 to the control electrodes of the display apparatus. Horizontal deflection signal generator 20 and vertical deflection signal generator 22 receive signal from the synchronization signal generator 19 and issue horizontal deflection signal and vertical deflection signal through the amplifiers 21 and 23 to the horizontal deflection electrodes and vertical deflection electrodes of the display apparatus, respectively. A cathode control circuit 24 receives signal from the synchronization signal generator 19 and issues control signal to the linear thermionic cathodes, in order that electron beams are selectively formed from the electrons from a selected one of linear thermionic cathodes in sequence by application of negative potential thereto with respect to the electrode 3, thereby to scan for the period of $m \times H$.

FIG. 1(*d*) shows waveforms (A), (B), (C), (D), (E), (F), and (G) of various parts of FIG. 1(*c*) circuit for the example of $n=3$ and $m=16$. The waveforms (A) and (B) are those of horizontal synchronization signal and vertical synchronization signal, wherein H designates the time period of one horizontal scanning and V designates the time period of one vertical scanning of the ordinary television signal. The waveforms (C) and (D) are voltages to be applied to the first and the second linear thermionic cathodes, respectively for switchingly operating the cathode in sequence. The waveforms (E) and (F) are issued from the vertical deflection signal generator circuit 22 and horizontal deflection signal generator circuit 20, respectively, and the waveform (G) is the control signal to be applied to the control electrode 4 of the display apparatus. Accordingly, the scannings of the beam spots seen at an enlarged part of the phosphor screen is as shown in FIG. 1(*e*).

In the picture display apparatus elucidated referring to FIG. 1(*a*) and FIG. 1(*b*), the electric field shielding electrode 8 is provided and a positive potential of several hundred volts against the horizontal deflection electrodes 7, 7' is impressed thereon. This electric field shielding electrode 8 serves to limit deflection angles of the electron beams by means of selecting sizes and positional relations of its square shaped openings with respect to paths of electron beams, and therefore, its apperture pattern must be very accurate. Accordingly, the electric field shielding electrode 8 is made lithographic process and hence its thickness is thin, and furthermore, in order to attain a high aperture ratio for high electron beams transmission its aperture size is large remaining very fine ribs inbetween. Such a thin electrode having very fine ribs has a difficulty in rigidity against shock or vibration and in stability of registration. Furthermore, by means of a high electric field at the electron 8, there has been a problem that the electron beam deflection is distorted when deflection angle is large, and removing of such distortion of deflection requires an increase of the voltage for deflection of the signal. The picture display apparatus of FIG. 1(*a*) and FIG. 1(*b*) has another problem that its deflection electrodes of thin parallel wire structure is likely to form sags or pattern distortions by means of thermal stress due to, for instance, a high temperature at its glass frit fixing, and such sags or pattern distortions leads to eventual nonuniformity or deflection angle at parts on the picture screen and hence to undesirable white or black lines on the reproduced picture due to overlapping of neighboring scanning lines or undue gap between the neighboring scanning lines.

SUMMARY OF THE INVENTION

The present invention provides a novel improved picture image display apparatus having electrodes for enabling a decrease of deflection voltage and improving quality of reproduced picture image.

BRIEF EXPLANATION OF THE DRAWINGS

FIG. 1(*a*) is an exploded perspective view showing the principal part of a display apparatus which has been described in the Japanese Patent Application No. Sho 53-106788 (published as unexamined patent gazette Sho 55-33734) and also described in the Specification of the U.S. Pat. No. 4,227,117.

FIG. 1(*b*) is a sectional view of the apparatus of FIG. 1(*a*).

FIG. 1(*c*) is a circuit diagram of a hitherto proposed picture image display apparatus.

FIG. 1(*d*) is a waveform chart showing waveforms of signals at various parts of the circuit of FIG. 1(*c*).

FIG. 1(*e*) is a chart showing the manner of scanning of picture beam spot.

DESCRIPTION OF THE PREFERRED EMBODIMENTS

The picture image display apparatus in accordance with the present invention comprises:

a flat type vacuum enclosure having a transparent face panel, a row of linear thermionic cathodes, in parallel, electron beam forming electrode which produces a predetermined number of two dimensionally disposed electron beams out of the electron emission from said linear thermionic cathodes, a row of control electrodes disposed parallel in a direction perpendicular to those of said linear thermionic cathodes, a row of deflection electrodes, a phosphor screen formed on the inner face of said face panel, and an anode of thin metal film formed on said surface of said phosphor screen, wherein the improvement is that a row of deflection-aiding electrodes is disposed between said row of deflection electrodes and said anode, said post deflection electrodes being impressed with substantially constant positive potential with respect to said linear thermionic cathodes.

Figure 2:
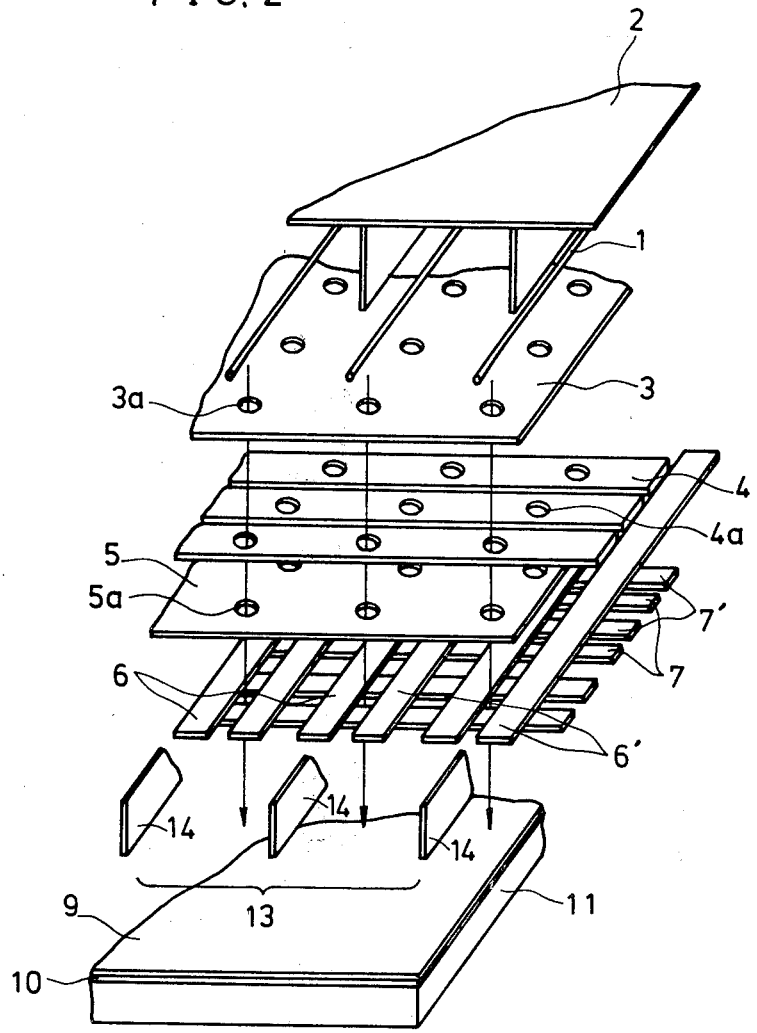
FIG. 2 is an exploded perspective view showing the principal part of a display apparatus embodying the present invention.
Figure 3:
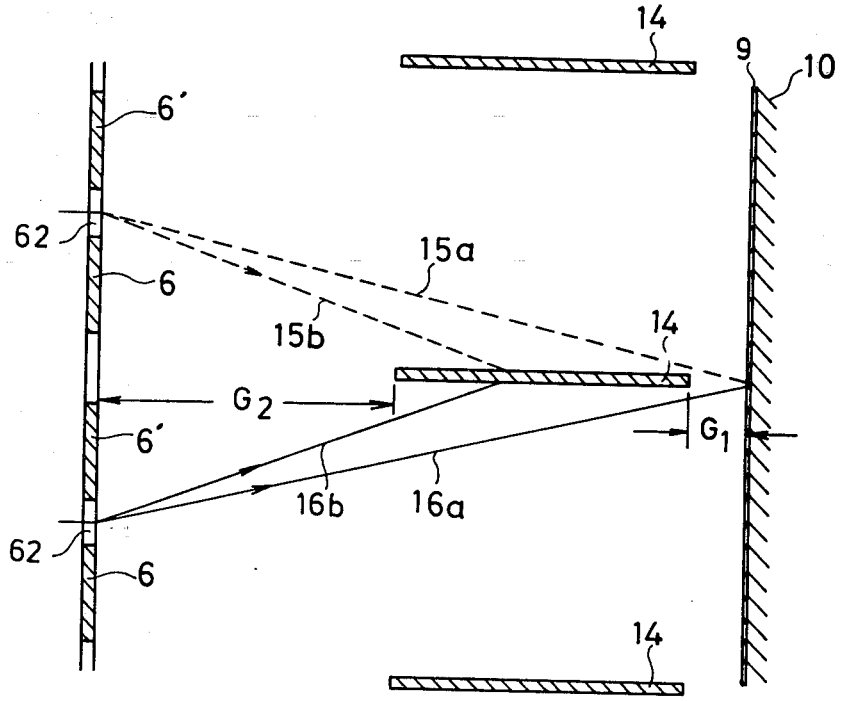
FIG. 3 is a schematical sectional view of a part of the apparatus of FIG. 2.

An example of the picture image display apparatus embodying the present invention is shown in FIG. 2 which is an exploded view of the principal part of the apparatus. The apparatus comprises, as shown from the upper part to the lower part in FIG. 2, an isolation electrode 2 having a plural number of isolation walls 201 to define oblong isolated spaces 202, a row of predetermined number of linear thermionic cathodes 1 each being disposed in parallel in the isolated spaces 202, an extractor electrode 3 having a predetermined number of electron beam passing apertures 3*a* disposed under the linear thermionic cathodes 1, a row of control electrodes 4 for controlling beam intensity disposed parallel in a direction perpendicular to those of said linear thermionic cathodes 1, each having electron beam passing openings 4*a* below the apertures 3*a*, an electron beam forming electrode 5 having electron beam passing openings 5*a* below the openings 4*a*, a row of vertical deflection electrodes comprising pairs of common-connected first electrodes 6 and common-connected second electrodes 6', a row of horizontal deflection electrodes comprising pairs of common-connected first electrodes 7 and common-connected second electrodes 7', a row 13 of deflection-aiding electrodes 14 disposed in parallel to the vertical deflection electrodes 6, 6', an anode 9 of vapor-deposited thin aluminum film, and a phosphor screen 10 formed on a face panel 11 of a vacuum enclosure. The deflection-aiding electrodes 14 are disposed in such a manner that center lines between neighboring two parallel deflection-aiding electrodes 14 coincide with center lines of the vertical deflection gaps 62 which are formed between the vertical deflection electrodes 6 and 6', and each of the oblong plate-shaped deflection-aiding electrodes 14 are disposed close to and along the surface of the anode 9 as shown in FIG. 2 and FIG. 3. Gaps $G_1$ between the lower edges of the deflection-aiding electrodes 14 and the anode 9 are preferably held to about 1.0 mm for the reason mentioned later. On the other hand, gaps $G_2$ between the upper edges of the deflection-aiding electrodes 14 and the lower face of the vertical deflection electrodes 6, 6' are preferably selected to be as large as possible in order to decrease required deflection electrode signal voltage and to increase effect of the deflection-aiding electrodes 14 to boost effective deflection angle; but the gaps $G_2$ should be at largest, in considering the overall thickness as of the flat type picture display apparatus, about 5 mm. The potential to be applied to the deflection-aiding electrodes 14 should be, as will be elucidated later, about the same as that of the anode 9.

The gist of the present invention is the deflection-aiding electrodes 14, and therefore, the structure of the electron beams emitting means and the structure of the electron beams deflecting means are not limited to those elucidated above, and any other suitable types of the electron beams emitting means and electron beams deflecting means can be utilized. For example, the isolation electrode 2 can be formed by conductive film coating formed on the upper inner wall of the vacuum enclosure, or in some case the isolation walls 201 can be dispensed with. The vertical deflection electrodes 6, 6' and the horizontal deflection electrodes 7, 7' are not necessarily disposed to neighbor each other, but, for example, the vertical deflection electrodes 6, 6' can be disposed between the electron extractor electrode 3 and the row of control electrode 4.

The function of the deflection-aiding electrode 14 is elucidated in detail referring to FIG. 3. When the electrode 6 is applied with a positive potential against the electrode 6', the electron beams are deflected downwards of FIG. 3 as shown by the dotted lines 15*a* and 15*b*. When the electrode 6' is applied with a positive potential against the electrode 6, the electron beams are deflected upwards of FIG. 3 as shown by the solid lines 16*a* and 16*b*. In the actual case, the paths of the electron beams are not straight as shown in FIG. 3, but for the simplicity of the elucidation, the paths are shown straight.

When the position of the vertical deflection electrode 6, 6' deviates from designed accurate position by, for example error in manufacturing step or thermal expansion etc., the vertical deflection angle of the electron beams resultantly differs from those designed. Therefore, in case there is no deflection-aiding electrodes provided, in some part of a band, which is a vertically divided part of the raster, its width (in vertical direction) of the band of scanning area on the phosphor screen produced by the electron beams of one selected linear thermionic cathode 1 becomes wider than designed or narrower than designed. Accordingly, the shape of the band, which is a vertically divided part of the raster, and hence should be a rectangle, becomes undesirably distorted, for example to have the arch like bent upper and/or lower edge of the band. Such distortion of the band results in overlapping of the neighboring bands in some parts or, on the contrary, forming gap between the neighboring bands in some parts, resulting in forming undersirable horizontal white lines or black lines. However, in the apparatus of the present invention, by means of the shielding action of the deflection-aiding electrodes 14, the over deflected electron beams 15*b* and 16*b* are prohibited from forming undue wide parts of the scanning band. That is, the band width is defined appropriate by means of the shielding action of the deflection-aiding electrode 14 even if the deflection angle is too large, and the electron beams 15*a* and 16*a* having the accurate deflection angle as designed results in continuous raster by smoothly connecting neighboring bands.

Figure 4:
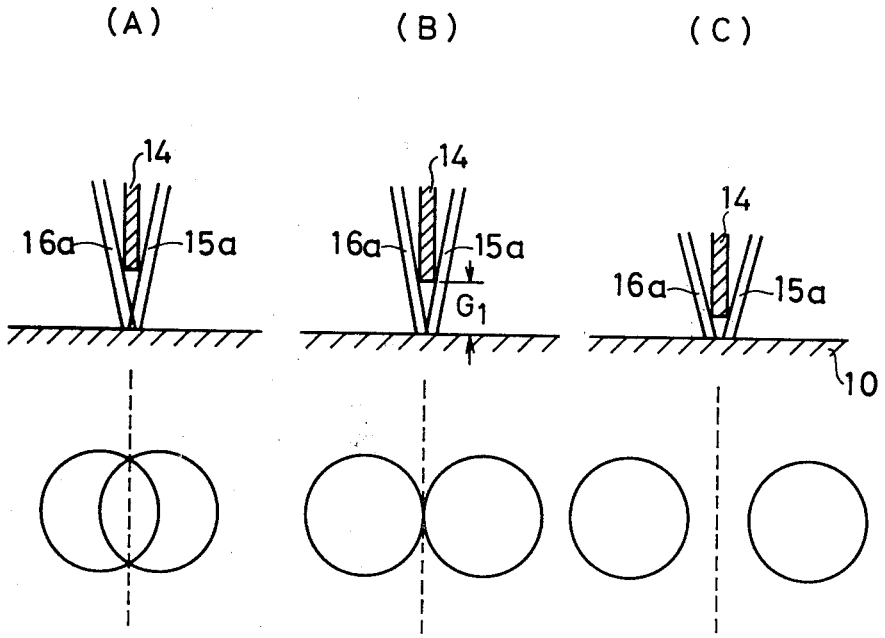
FIG. 4 are schematical sectional views of a part of the apparatus of FIG. 2.

The gap $G_1$ between the deflection-aiding electrode 14 and the anode 9 should be suitably selected in order to obtain perfect raster without undesirable white or black lines between the neighboring bands. This is elucidated with reference to FIG. 4, schematically showing sectional views of the deflection-aiding electrode 14 and deflected electron beams 15*a* and 16*a* with beam spots on the screen in enlarged scale below each sectional view. In FIG. 4, the electron beams 15*a* and 16*a* are effective most deflected electron beams to form the beam spots. That is, the electron beams having deflection angles larger than those of 15*a* and 16*a* wastefully impinges the deflection-aiding electrodes 14. When the gap $G_1$ is appropriate as shown in the case (B), the maximum deflected spots of neighboring band are disposed appropriately so as to smoothly connect the boundary to neighboring bands. However, when the gap $G_1$ is too large as shown in the case (A), the spots of the neighboring bands overlap, thereby forming the undesirable white lines, and when the gap $G_1$ is too small, as shown in the case (C), the spots of the neighboring bands apart, thereby forming the undesirable black lines. The actual size of the gap $G_1$ depends on the thickness of the deflection-aiding electrode 14 and the designed maximum deflection angle of the electron beam.

Figure 5:
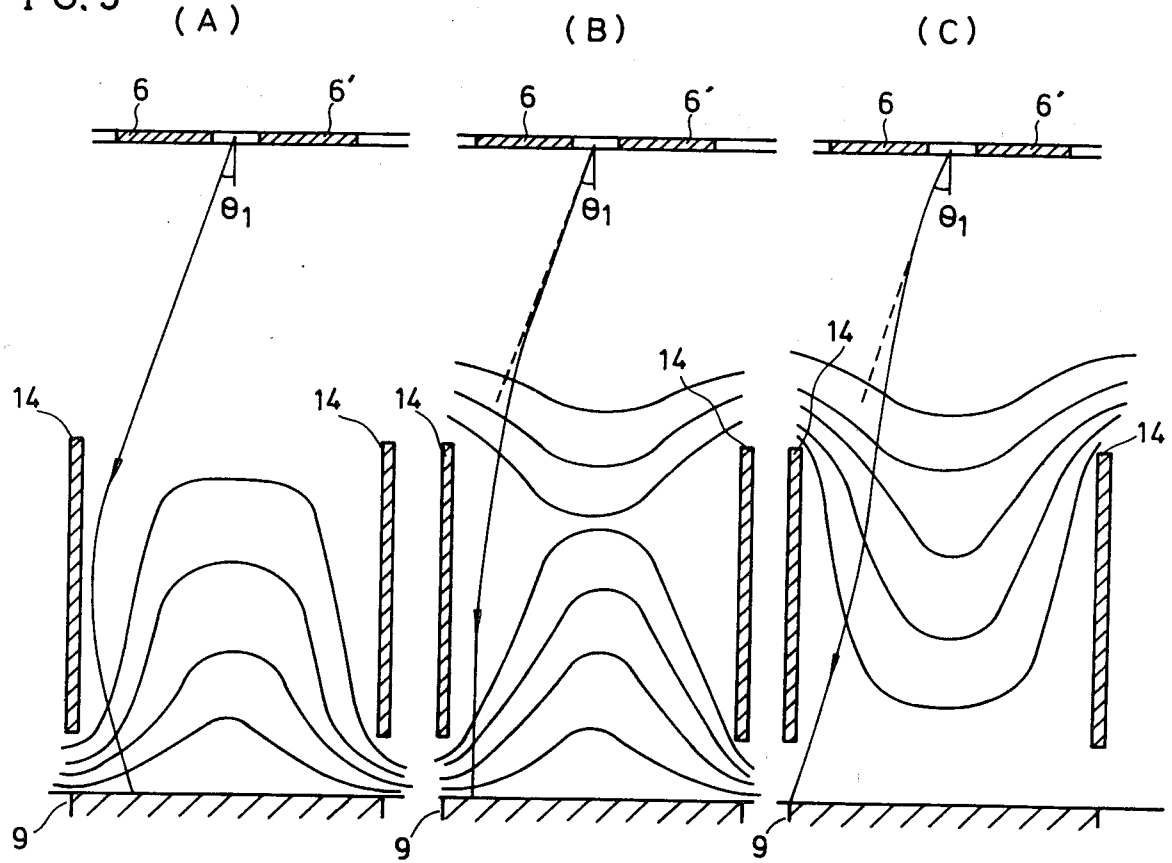
FIG. 5 are schematical sectional views of the apparatus embodying the present invention.

FIG. 5 illustrates the function of the deflection-aiding electrodes 14 more in detail in relation with the electric potential applied thereto, by showing equipotential lines of the electric field lens and electron beam path therein. In FIG. 5, the case (A) is for that the potentials of the deflection-aiding electrodes 14 are substantially the same as that of the cathodes 1. In this case, the electron beam paths are bent inwardly (i.e., convergingly), and therefore, the width of the deflection of the spot is effectively narrowed; thereby the undesirable black lines are produced between the neighboring bands due to lack of the band width. In the case (B), the potential of the deflection-aiding electrodes is selected about the midway between those of the cathode 1 and the anode 9. In this case, the electron beam paths are bent slightly inwards near the upper ends of the deflection-aiding electrodes 14, and again bent inwards near the lower ends of the deflection-aiding electrodes 14, so that the electron beams impinge the screen almost perpendicularly thereto. By such inwards bendings of the electron beam paths, the undesirable black lines are formed between the neighboring bands due to lack of the band width. In the case (C), the potential of the deflection-aiding electrodes 14 is selected very high, for instance, about the same as that of the anode 9. In this case, though the electron beam paths are slightly bent inwards near the upper ends of the deflection-aiding electrodes 14, they are then bent outwards near the lower ends of the deflection-aiding electrodes 14. Therefore, the effective deflection width of the band is widened by the function of divergence lens by the electric field, thereby attaining a smooth raster without the undesirable black lines due to lack of the deflection width. This means that by application of the high potential to the deflection-aiding electrodes 14, the initial deflection angle $\theta_1$ can be decreased by reducing the deflection signal voltage, in comparison with the conventional case without the deflection-aiding electrodes. In other aspect, by using the deflection-aiding electrodes 14 in accordance with the present invention, the apparatus can be designed to have a larger deflection width in comparison with the conventional apparatus, thereby enabling a reduction of the number of cathodes 1, together with the reduction of the number of vertical electrodes 6, 6'.

The experimental study shows that the potential from that of the cathodes 1 to be applied to the deflection-aiding electrodes should be higher than 60% of the potential to the anode.

Figure 6:
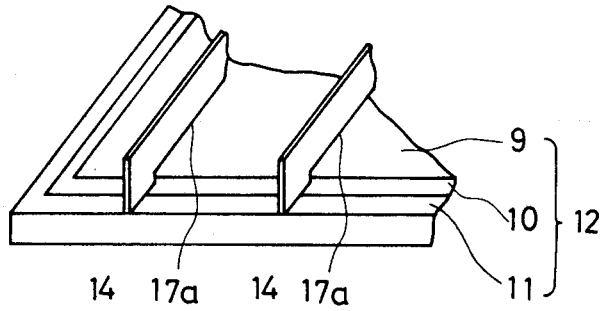
FIG. 6 is a perspective view of the principal part of an apparatus embodying the present invention.

FIG. 6 and Figures thereafter show practical structural examples of the deflection-aiding electrode in accordance with the present invention.

A first example of FIG. 6 has a row of deflection-aiding electrodes 14, each having offset lower edge except at both ends thereof, so that when the deflection-aiding electrodes 14 are disposed on a face panel 12 comprising a glass panel 11, a phosphor screen 10 and an anode 9, each lower edge of the deflection-aiding electrodes 14 is disposed on the anode 9 with a pre-determined gap (corresponding to the gap $G_1$ of FIG. 3 and FIG. 4) by forming a long cut out part 17*a*. The deflection-aiding electrodes 14 are made by working glass or ceramic by mechanical working etching technology followed by vacuum deposition and/or screen process to form metal films or by working metal sheet followed by metal-etching. The gap $G_1$ should be preferably selected to be 1 to 10 times as large as the thickness of the deflection-aiding electrodes 14 in order to obtain appropriately continuous bands of raster.

Figure 7:
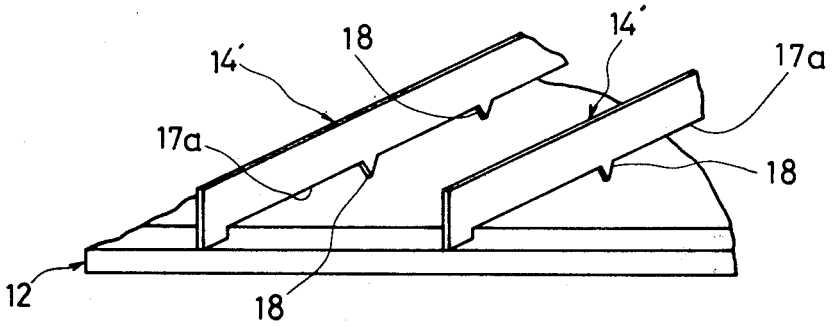
FIG. 7 is a perspective view of the principal part of another apparatus embodying the present invention.

FIG. 7 is a perspective view of another example wherein deflection-aiding electrodes 14' have protrusions 18 to contact the inner face of the face panel 12, to retain a predetermined gap $G_1$ defined by the height of the protrusions 18.

One example of the deflection-aiding electrodes 14 or 14' is as follows:

The electrodes 14 or 14' are made of metal sheet of 0.2 mm thickness; the width and length of the electrodes 14 are 5.0 mm and 120.0 mm, the width of the cut out part 17*a* is 0.5 mm. The electrodes are held at both ends by a holder made of metal and having U-shaped section, and the electrodes 14 are held on the anode 9 on the phosphor layer 10 with gaps $G_1$ to 0.5 mm at all parts. The electrodes 14 and the holder can be made of glass sheet or ceramic sheet having metal film coating thereon formed by vacuum deposition of Al and Ag. A substantially the same potential as that of the anode with respect to the cathode is applied to the deflection-aiding electrode. When an all white pattern signal is applied on the control electrodes, a white picture of a substantially uniform luminance with white or black lines on all the raster is obtained.

Figure 8:
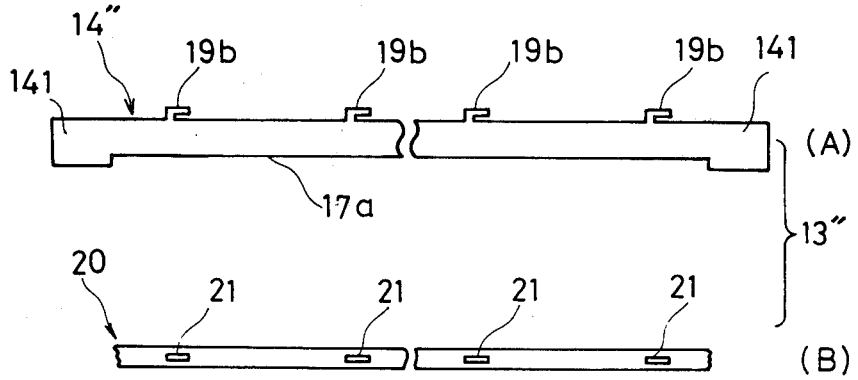
FIG. 8 shows components of an electrode in accordance with the present invention.
Figure 9:
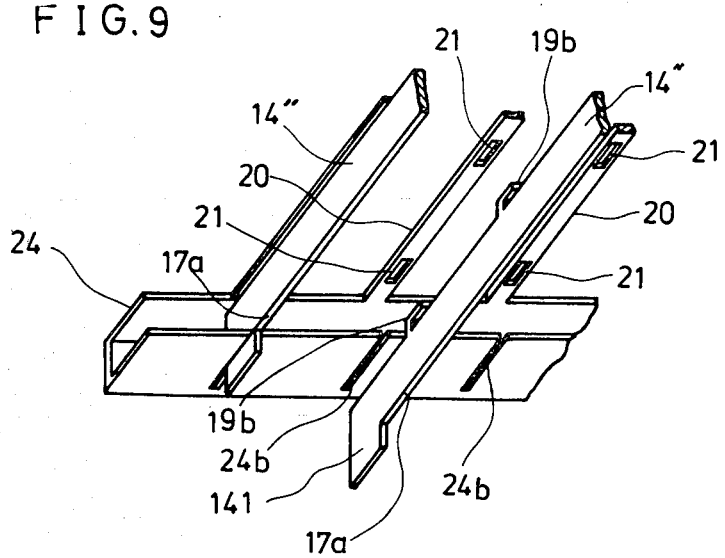
FIG. 9 is a perspective view of an electrode structure formed by using the components of FIG. 8.

FIG. 8 shows another example, wherein each deflection-aiding electrode 14'' (A) has hooks 19*b* on its upper edge, and the hooks 19*b* are inserted in and engages with holes 21 of a reinforcing bars 20 (B), so that the deflection-aiding electrodes 14'' acquire great rigidity by T-section structure. In actual construction shown in FIG. 9, the deflection-aiding electrodes 14'' are held at their both ends 141 in slots 24*b* of a holder 24 having U-shaped section. In an example, the deflection-aiding electrodes 14'' are made of 0.2 mm thick metal sheet of 4.0 mm width and 120 mm length, and have cut out part has 0.5 mm width and 110 mm length. The holder is made of 0.2 mm thick metal sheet by means of etching process, and pitch of the slots 24*b* is 5.0 mm, width of the slots 24*b* is 0.25 mm, and the hooks 19*b* are formed with 30 mm pitch. The engagement of the hooks 19*b* with the holes 21, and the engagement of the end parts 141 of the electrodes 14'' in the slots 24*b* in the holder 24 are fixed by known conductive paste. The metal sheets of the deflection electrodes 14'', reinforcing bars 20 and the holder 24 are, for example, 42-6 alloy (having a contents ratio of Fe 52%, Ni 42% and Cr 6%) by metal etching process for the purpose of mass production with high accuracy. By taking such T-shape section construction, a high rigidity and hence accuracy of size and shape are obtainable.

Figure 10:
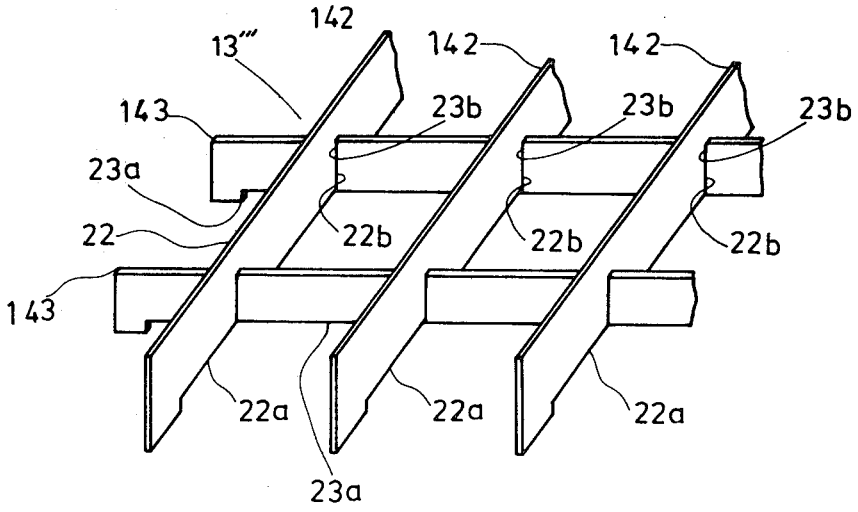
FIG. 10 is a perspective view of another electrode embodying the present invention.

FIG. 10 shows still another example of the deflection-aiding electrodes having a lattice structure which has a parallel row of first deflection-aiding electrodes 142 and another parallel row of second deflection-aiding electrodes 143, the first electrodes 142 and the second electrodes 143 crossing with right angle each other. Such lattice shape structure is very rigid and strong, and hence is suitable for a large picture display apparatus. The preferable locations of the electrodes 142 and 143 should be such that the vertically disposed electrodes 142 are on the boundary lines $B_V$ between horizontally neighboring scanning sections of horizontally divided vertically oblong sections on the raster (one example is shown in FIG. 1(*e*)), and the horizontally disposed electrodes 143 are on the boundary lines $B_H$ between vertically neighboring scanning sections of vertically divided vertically oblong sections on the raster (for example in FIG. 1(*e*)). In this example of FIG. 10, the vertically disposed electrodes 142 is wider than the horizontally disposed electrodes 143, but the relation of the width of these electrodes can be interchanged. In the example of FIG. 10, the width of the electrodes 142 and 143 are 5 mm and 4 mm, respectively and their lengths are 95 mm and 120 mm, respectively, and thickness are both 75 μm. Width of the cut out parts 22*a* and 23*a* are both 0.5 mm and their lengths are 85 mm and 110 mm, respectively. Engaging of the vertically disposed electrodes 142 and the horizontally disposed electrodes 143 are carried out by engagement of slits 22*b* on the electrodes 142 and slits 23*b* on the electrodes 143. The assembled lattice structure is fixed by using known conductive paste at the crossings.

As has been elucidated, the deflection-aiding electrodes 14 in accordance with the present invention serves (1) to define actual deflection width of a band of raster on the screen, thereby to prevent undesirable partly overlapping of the neighboring bands caused by partial distortions of the electrode structure hence eliminating undesirable white line due to the overlapping, (2) to increase deflection angle by bending the electron beam outwards by means of the electric field lens formed by the deflection-aiding electrodes 14 and the anode 9, thereby in another aspect enabling a reduction of the deflection signal intensity and (3) to make fine adjustments of the raster to eliminate undesirable white and/or black lines between the neighboring bands by dividing the deflection-aiding electrodes into at least two groups of different location and adjusting the respective potentials applied to the group.

I claim:

1. A picture image display apparatus comprising:

a flat type vacuum enclosure having a transparent face panel, a row of linear thermionic cathodes disposed in parallel, electron beam forming electrode for producing a predetermined number of two dimensionally disposed electron beams out of the electron emission from said linear thermionic cathodes, a row of cntrol electrodes disposed in parallel in a direction perpendicular to those of said linear thermionic cathodes, a row of deflection electrodes, a phosphor screen formed on the inner face of said face panel, and an anode of thin metal film formed on the surface of said phosphor screen, wherein the improvement is that (i) a row of deflection-aiding electrodes is disposed between said row of deflection electrode and said anode, (ii) said deflection-aiding electrodes are provided with cut out portions on the side of said face panel so as to provide gaps 1 to 10 times the thickness of said deflectioin-aiding electrode, between lower edge of said deflection-aiding electrode and the surface of said anode, and (iii) said deflection electrodes are adapted for impressing substantially constant positive potential with respect to said linear thermionic cathodes.

2. A picture image display apparatus in accordance with claim 1, wherein said deflection-aiding electrodes are parallel electrodes of oblong sheet disposed near and along said anode in the manner that face of its oblong sheet is in perpendicular with the face of said anode and parallel to said linear thermionic cathodes.

3. A picture image display apparatus in accordance with claim 2, wherein said deflection-aiding electrodes are disposed at the same pitch with that of the linear thermionic cathodes.

4. A picture image display apparatus in accordance with claim 2, wherein each of said deflection-aiding electrodes has a reinforcing bar connected on the upper edge thereof to form a T-shape section.

5. A picture image display apparatus in accordance with claim 2, wherein said deflection-aiding electrodes forming a lattice structure comprising first parallel deflection-aiding electrodes and second parallel deflection-aiding electrodes, said first and second parallel deflection-aiding electrodes being disposed perpendicular to each other and connected each other.

6. A picture image display apparatus in accordance with claim 1, wherein said constant positive potential is higher than 60% of the potential of said anode with respect to said linear thermionic cathodes.

* * * * *